United States Patent [19]

Chia

[11] 4,067,731

[45] Jan. 10, 1977

[54] METHOD OF TREATING MOLTEN METAL

[75] Inventor: Enrique C. Chia, Carrollton, Ga.

[73] Assignee: Southwire Company, Carrollton, Ga.

[21] Appl. No.: 693,455

[22] Filed: June 7, 1976

Related U.S. Application Data

[62] Division of Ser. No. 597,312, July 19, 1975, Pat. No. 4,007,923.

[51] Int. Cl.[2] ..... C22B 21/06

[52] U.S. Cl. ..... 75/68 R; 75/63; 75/65 R; 75/93 AC

[58] Field of Search ..... 75/68 R, 93 R, 93 AC, 75/63, 65

[56] References Cited

U.S. PATENT DOCUMENTS

| | | | |
|---|---|---|---|
| 3,737,304 | 6/1973 | Blayden et al. | 75/68 R |
| 3,752,662 | 8/1973 | St Cesaire | 75/68 R |
| 3,869,282 | 3/1975 | Curran et al. | 75/82 |
| 3,870,511 | 3/1975 | Szekely | 75/68 R |
| 3,962,081 | 6/1976 | Yarwood et al. | 75/68 R |

*Primary Examiner*—M. J. Andrews

*Attorney, Agent, or Firm*—Herbert M. Hanegan; Stanley L. Tate; Robert S. Linne

[57] ABSTRACT

A method of treating molten aluminum and aluminum alloys to remove solid and gaseous impurities therefrom is disclosed. Molten metal is flowed through an integrated series of successively arranged purification stages including a deslagging stage wherein relatively large particulate impurities are removed from the molten metal by filtering the same through a woven refractory filter, a fluxing stage for removing entrapped and dissolved hydrogen from the molten metal, an adsorption stage wherein the molten metal is passed over a plurality of impurity-adsorbing refractory plates and a final filtration stage wherein the finer particulate impurities are removed by filtering the molten metal through a rigid, porous refractory filter medium.

11 Claims, 2 Drawing Figures

METHOD OF TREATING MOLTEN METAL

This is a division of application Ser. No. 597,312, filed July 19, 1975, now U.S. Pat. No. 4,007,923.

BACKGROUND OF THE INVENTION

This invention relates generally to the treatment of molten metals, and more particularly to a method of purifying molten metals, such as aluminum and aluminum alloys.

In one type of conventional continuous casting operation, aluminum or an alloy thereof is melted in a furnace and transferred via other receptacles to the pouring tundish of a continuous casting machine. Entrained within the molten aluminum are oxides of other metals existing as impurities, non-metallic oxides and other solid contaminants in particle form, such as, for example, finely divided particles of aluminum oxide broken off from the skin which forms on the surface of the molten aluminum. In addition, gaseous products, particularly hydrogen gas generated by reaction of the molten aluminum with moisture in the various receptacles of the system and in the surrounding environment, are commonly entrapped or disoolved in the molten aluminum. If not removed from the molten metal prior to the casting thereof, both the particulate matter and the gaseous products may contribute to undesirable voids and inclusions in the cast metal. When the cast metal is subsequently worked to produce a final product, such as continuously formed rod and wire, the inclusions and voids frequently cause flaws resulting in breaks and fissures in the worked product, poor mechanical properties and a reduction of the electrical conductivity of the final product.

The prior art proposals for overcoming the aforementioned difficulties include a number of methods of and apparatus for removing gaseous hydrogen from the molten metal by passing a fluxing gas therethrough. Many filtering systems and processes have also been proposed for removing the solid particulate impurities from the molten aluminum prior to the introduction of the metal into a casting mold. A number of well-known prior art fluxing and filtering systems employ a filter medium comprising a bed of loose refractory granules, such as, for example, aluminum oxide balls, through which the molten aluminum is passed in countercurrent relation to a fluxing gas. The aluminum treatment systems disclosed in U.S. Pat. No. 3,039,864 and U.S. Pat. No. 3,737,304 typify such prior art fluxing and filtering systems. With the prior art granular filter mediums, however, control of the particle size being filtered is not readily accomplished and the filter beds are often subjected to channeling problems which result in loss of filtering efficiency and frequent clogging. A clogged filter bed, of course, requires either a system shutdown to remove and replace the filter bed or, at least, an interruption of the casting operation to perform a cleaning of the filter bed in situ.

Other prior art filtering systems, such as that disclosed in U.S. Pat. No. 3,654,150, utilize a filter medium formed of one or more contiguous layers of a woven glass cloth fabric or screen through which the molten aluminum is filtered before it is introduced into the casting machine. Extreme caution must be taken, however, when using such glass cloth filters in order to prevent their rupture because of the deleterious effects on the strength of the glass fibers by the high temperature molten aluminum. In many instances, prior filtering systems using glass cloth filters are rendered ineffective by a rapid buildup of large quantities of particulate matter resulting in the clogging of the filter medium and the necessity to terminate operations to replace or renew the filter medium. Frequently, and especially as the filter becomes contaminated with filtered particulate matter, the downstream side of a glass cloth filter may be exposed to air because of the filter location or orientation or because of the flow rate at which the filtered matal is withdrawn. This results in the formation of aluminum oxide on the downstream side of the filter as well as an undesirably large pressure differential across the filter, the force of which could rupture the same.

SUMMARY OF THE INVENTION

In view of the foregoing, it should be apparent that there still exists a need in the art for a method for substantially continuously fluxing and filtering molten aluminum wherein the molten metal flow is deslagged and pre-filtered to remove relatively large particles so as to prevent frequent clogging of subsequently arranged purification stages designed to remove the more finely divided particulate matter and wherein a fluxing stage is arranged intermediately of the deslagging and final purification stages. It is, therefore, a primary object of this invention to provide an improved method for fluxing and filtering molten metal which is characterized by a number of successive filtering and purifying stages arranged in such a manner as to achieve a cast product wherein the number of inclusions and voids is substantially eliminated.

More particularly, it is an object of this invention to provide a continuous treatment system for purifying molten aluminum and aluminum alloys which includes at least four purification stages, namely, a deslagging stage, a fluxing stage, an adsorption stage and a final filtration stage.

Still more particularly, it is an object of this invention to provide a method for treating molten aluminum and its alloys wherein a submerged woven refractory cloth filter is removably mounted in a deslagging stage for removing large solid particles and wherein the molten metal is passed through a porous refractory filter medium having an effective area of at least twice the cross-sectional area of the molten metal flow path.

A further object of this invention is to provide a method of purifying molten aluminum in a multiple stage fluxing and filtering system wherein the molten aluminum is deslagged and pre-filtered in a deslagging stage, fluxed by a countercurrent flow of inert fluxing gases in a fluxing stage, passed through a surface adsorption medium where relatively minute impurities are adsorbed, filtered through a rigid, porous refractory filter medium and thereafter delivered to the tundish of a continuous casting machine or the like.

Still another object of this invention is to provide a method for continously purifying molten aluminum and aluminum alloys by deslagging and pre-filtering the molten aluminum to remove relatively large size solid impurities introduced into the treatment system, fluxing the molten metal to remove the hydrogen gas therefrom, adsorbing relatively minute impurities by passing the molten metal over an adsorptive refractory material and filtering the molten metal in a final purification stage.

Yet another object of the present invention is to provide a method for treating molten metal which includes passing the molten aluminum in relatively thin layers over a reactive surface having an adsorptiove affinity for impurities in the molten aluminum.

Briefly described, these and other objects of the invention are accomplished in accordance with its method aspects by flowing the molten aluminum through a refractory receptacle divided into four successively arranged purification stages. In the primary or deslagging stage, one or more filters comprising a cloth screen woven of filaments of a refractory material are submerged in the molten metal perpendicular to the direction of flow thereof. At least two woven filter positions are provided in the deslagging stage so that at least one operable filter may be positioned across the molten metal flow path even if the other filter has been removed for cleaning.

After passing through the woven refractory filter, the molten metal is transferred to a second or fluxing stage wherein a series of vertically arranged baffles direct the molten metal flow in countercurrent relation to a pair of spaced diffuser heads from which is dispersed a fluxing gas. Thereafter, the molten metal is directed through a third or adsorption stage which comprises a series of parallelly arranged horizontal plates formed of a refractory material having an adsorptive affinity for one or more of the impurities known or expected to be present in the molten metal. Minute particles of such impurities adhere to the surfaces of the adsorptive plates and are thereby removed from the molten aluminum.

From the adsorption stage, the molten metal is subjected to a fourth or final purification treatment by filtration through a filter medium formed of rigid, porous refractory material disposed immediately upstream of the treatment system outlet to the tundish of the continuous casting machine. The porous filter is designed in such manner as to provide a surface area substantially greater than the total cross-sectional area of the flow path and, preferably, at least twice as great.

The filtering and fluxing method of the present invention are particularly advantageous in that the plural purification stages insure that the occurrences of inclusions and voids caused by particulate matter and entrapped gases in the continuously cast product are minimized. While the above system and method have been described in relation to the special applicability of the invention to the continuous casting of aluminum and aluminum alloys, it will be apparent to those skilled in the art that many of the advantages, features and benefits of the present invention are equally applicable to the casting of other metals and to casting operations other than continuous casting.

In view of the foregoing and other objects, advantages and features of the invention that may become hereinafter apparent, the nature of the invention may be more clearly understood by reference to the following detailed description, the appended claims and to the illustrative embodiment shown in the attached drawings.

DETAILED DESCRIPTION OF A PREFERRED EMBODIMENT

Figure 1:
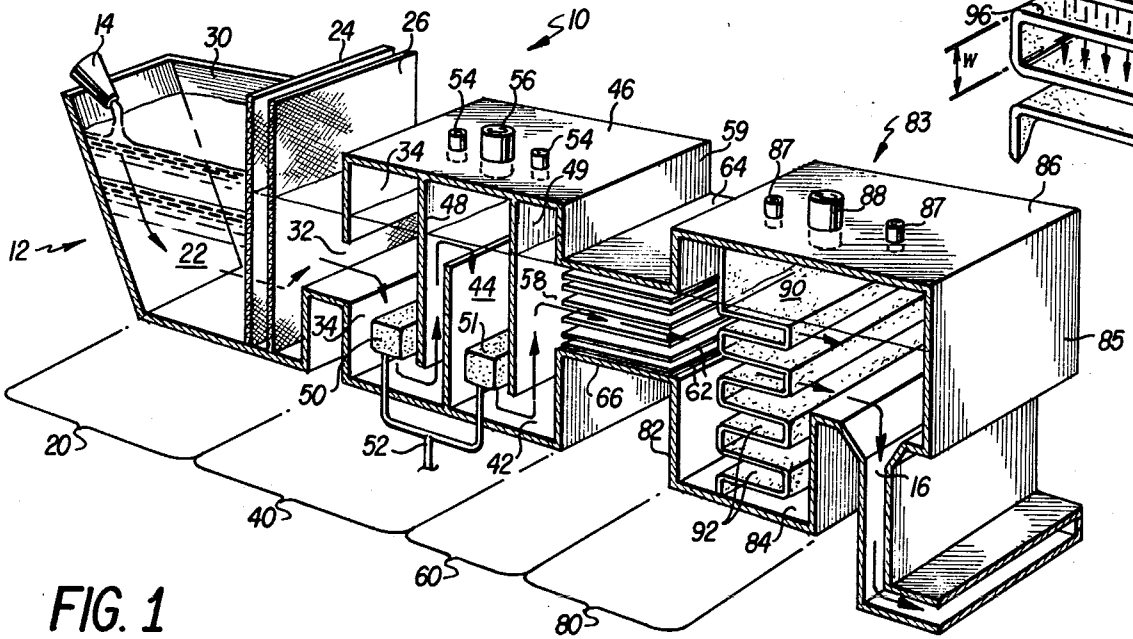
FIG. 1 is a perspective view in section illustrating an embodiment of a molten aluminum purification system according to the present invention.

Referring now in detail to the drawings, there is illustrated in FIG. 1, in cross-section, a continuous treatment system for purifying molten aluminum or aluminum alloys constructed in accordance with the principles and teachings of the present invention. The treatment system, designated generally by reference numeral 10, comprises a substantially rectangular chamber or receptacle 12 divided into four interconnected treatment or purification stages, namely, a deslagging and pre-filtering stage 20, a fluxing stage 40, an adsorption stage 60, and a final filtration stage 80. The receptacle 12, as illustrated, may comprise a series of separate, interconnected vessels or may be combined in a non-illustrated form comprising a unitary integrated structure. The molten metal-contacting surfaces of the receptacle 12 are formed of refractory materials which have an affinity for the various impurities usually found in molten aluminum or aluminum alloys.

Molten aluminum to be purified is introduced into the treatment system 10 from a melting or holding furnace (not shown) via an inlet spout 14. The molten metal flows through the various purification stages as depicted by the broken arrows in FIG. 1 and is discharged from the system as purified metal through an outlet pipe 16 which may be suitably positioned to supply molten metal to the tundish of a continuous casting machine (not shown).

In the initial purification stage, the deslagging stage 20, molten aluminum is introduced into an uncovered pot 22 provided with a pair of vertically disposed filter elements 24, 26 the purpose of which is to filter out most of the dross, larger oxide particles and other relatively large impurities contained in the molten metal issuing from the holding furnace. The filters 24, 26 are partly submerged in the molten metal contained in the pot 22 and are arranged to sealingly contact the floor and both sidewalls 30 (only one shown) thereof in such a manner that the entire cross-section of the molten metal flow must pass through the filters. As shown, both filters 24, 26 are preferably in place during operation of the treatment system, however, a single filter may be used with no substantial adverse effect on the overall purification capability of the system. In either case, at least two filter positions are preferably provided so that a clogged or damaged filter element may be readily replaced even during periods when the system is fully operational. The use of two filter elements assures that no substantial dross, oxide particles or the like will be introduced downstream of the deslagging stage in the event that one of the filter elements ruptures or otherwise fails. The filter elements 24, 26 are formed of a suitable material resistant to the molten aluminum or aluminum alloy, such as, for example, a woven refractory cloth material formed of boron nitride filaments.

From the deslagging stage 20 the molten metal flows into the fluxing stage 40 through a submerged aperture 32 provided in the common wall 34 separating the deslagging and fluxing stages. The fluxing stage 40 includes a floor 42 from which an upwardly disposed vertical baffle member 44 projects and a removable top cover 46 which is provided with a pair of downwardly projecting vertical baffle members 48, 49 arranged parallel to and straddling the baffle member 44.

In the lowermost portion of the fluxing stage 40 a pair of spaced diffuser heads 50, 51, which may be formed of porous carbon, are connected via a line 52 to a source (not shown) of fluxing gas. The diffuser heads 50, 51 are arranged to disperse the fluxing gas in countercurrent relation to the molten metal flowing respectively in a channel between the wall 34 and baffle member 48 and a channel between the baffle members 44 and 49. The fluxing gas may consist of any of the well-known gases or mixtures thereof suitable for fluxing the entrapped or dissolved hydrogen gas from the molten aluminum, such as, for example, chlorine, nitrogen, argon and other inert gases.

The removable top cover 46 is provided with burner heads 54 communicating with the interior of the fluxing stage 40 for burning a combustible mixture to maintain the temperature in stage 40 sufficiently high to prevent freeze-up or solidification of the molten aluminum. A gas exhaust port 56 is also provided in the top cover 46 for venting both degassed hydrogen and the fluxing gas. After passing beneath the vertical baffle member 49, the molten metal flows into the adsorption stage 60 through a submerged aperture 58 in the downstream wall 59 of the fluxing stage 40.

In the adsorption stage 60, a plurality of flat adsorption plates 62 formed of a refractory material are arranged between a removable top plate 64 and a bottom plate 66 in closely spaced, parallel relation to each other and to the flow of molten aluminum. The molten aluminum is channeled through the narrow passages between the plates 62 which present a large adsorptive surface area over which the molten metal flows in relatively thin streams. Impurities, in the form of minute particulate matter having an affinity for the material of the plates 62, will adhere to the reactive surfaces of the plates, thus further purifying the molten metal passing through the adsorption stage 60.

The arrangement of the plates 62 in the adsorption stage 60 is equivalent to flowing the metal in a relatively thin layer over a large adsorptive surface so as to maximize contact of the molten metal with such surface. The adsorptive material of the plates 62 is preferably selected based on the impurity of the highest concentration contained in the molten metal, for example, calcium oxide may be a preferred adsorptive material when the impurity concentration is highest in iron or lead. Other materials such as mullite, aluminum oxide and silicon carbide, each having an adsorptive affinity for different impurities could also be used depending on the expected impurities and the approximate concentration thereof.

After passing between the plates 62 of the adsorption stage 60, the molten aluminum flows through the opening 81 in the upstream wall 82 of filtration stage 80. The filtration stage 80 includes an enclosed vessel 83 having a floor 84 end wall 85 and a removable top cover 86 which is provided with a pair of burner heads 87 and an exhaust port 88 in a manner similar to the top cover of the fluxing stage 40. The filter medium 90 is positioned in the vessel 83 and extends from the floor 84 thereof to a point adjacent the top cover 86.

Figure 2:
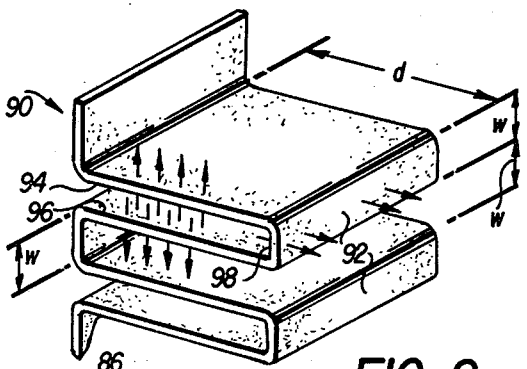
FIG. 2 is a perspective view illustrating a portion of the rigid refractory filter medium of the present invention.

Filter 90 is fabricated of a rigid, porous refractory material resistant to extended immersion in molten aluminum and is designed to provide a large surface area through which the molten aluminum is constrained to flow. One example of a suitable material for the filter 90 would be small fused alumina particles bonded together with a vitreous material and fired. The preferred configuration of the filter 90 is shown in FIG. 2 and comprises a plurality of horizontally disposed troughs or channels 92 integrally interconnected with each other to form a rigid sinuous or undulating shape. Each channel 92 is generally U-shaped and is oriented in the direction of molten aluminum flow through the filtration stage 80, that is, substantially horizontally.

As the molten metal flows from the adsorption stage 60 into the channels 92 of the filter medium 90, it will be diverted into a plurality of directions in each channel so as to impinge upon the upstream channel surfaces 94, 96, 98 and pass through the channel walls in the directions depicted by the arrows in FIG. 2. It will be appreciated by those skilled in the art that the total effective surface area available for filtration will be greater than the cross-sectional area of the flow path of the molten metal by the approximate ratio of the depth $d$ of a channel 92 to the width $w$ thereof. The purified molten aluminum or aluminum alloy passing through the filter 90 arrives at the outlet conduit 16 substantially free of oxide particles and entrapped or dissolved gases, ready for delivery to the tundish of a continuous casting machine.

It should be apparent from the foregoing description that the present invention provides a novel method for treating molten aluminum and aluminum alloys to remove therefrom substantially all impurities in the form of oxide particles and other solid particulate matter by adsorption and filtration and entrapped or dissolved gases such as hydrogen by fluxing with chlorine, nitrogen, argon or other inert gases or mixtures thereof.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A method of continuously treating molten aluminum and aluminum alloys to remove impurities and gases therefrom comprising the steps of:

a. deslagging by filtering the molten aluminum to remove relatively large size solid impurities therefrom;

b. fluxing the molten aluminum to remove hydrogen gas therefrom;

c. adsorbing selected impurities by passing the molten aluminum over an adsorptive refractory material having an adsorptive affinity for said selected impurities in the molten aluminum; and d. filtering the molten aluminum through a rigid porous refractory filter medium to remove impurities not removed in said deslagging and adsorbing steps.

2. Method according to claim 1 wherein the step of fluxing the molten metal includes passing a fluxing gas in counter-current relation to the molten metal flow.

3. Method according to claim 1 wherein the step of deslagging by filtering the molten aluminum includes filtering the molten metal through a filter medium fabricated of woven refractory filaments.

4. Method according to claim 2 wherein the fluxing step further includes the step of directing the molten metal flow in alternate, substantially vertical directions and passing the fluxing gas countercurrently through the molten metal when the flow is substantially downwardly directed.

5. Method according to claim 4 including the step of passing fluxing gas at least twice through the molten metal.

6. Method according to claim 1 wherein the step of adsorbing selected impurities includes flowing the molten aluminum over a plurality of spaced, parallel refractory plates arranged in parallel relation to the direction of flow of the molten metal.

7. The method according to claim 1 wherein said adsorptive refractory material is selected from the group consisting of aluminum oxide, calcium oxide, mullite, and silicon carbide and wherein said impurities comprise solid particulate matter in the form of oxide particles and entrapped gases.

8. The method according to claim 2 wherein the step of passing a fluxing gas through the molten metal includes the step of providing a fluxing gas selected from the group consisting of chlorine, nitrogen, argon or other inert gas and mixtures thereof.

9. A method of continuously fluxing and filtering molten aluminum and aluminum alloys to remove impurities and gases therefrom comprising the steps of:

a. deslagging the molten aluminum to remove relatively large size solid impurities therefrom by filtering the molten aluminum through at least one filter woven of refractory filaments;

b. fluxing the molten aluminum to remove hydrogen gas therefrom by flowing a gas in countercurrent flow through the molten aluminum in a first flow channel and subsequently flowing a gas in countercurrent flow through the molten aluminum in a second flow channel;

c. adsorbing selected impurities in the molten aluminum by flowing the molten aluminum in thin, unidirectional streams over a plurality of spaced, parallel plates fabricated of a refractory material having an adsorptive affinity for said selected impurities in the molten aluminum;

d. filtering the molten aluminum to remove impurities not removed in said deslagging and adsorbing steps by passing the molten aluminum through a rigid, porous refractory filter having an undulating shape formed by a plurality of interconnected, horizontally disposed channels.

10. Method according to claim 9 wherein the molten aluminum is discharged into the tundish of a continuous casting machine after treating said metal.

11. An improved method of continuously treating molten metal to remove impurities therefrom wherein the improvement comprises the steps of:

a. deslagging the molten metal to remove relatively large sized solid impurities therefrom by filtering said metal through at least one filter woven of refractory filaments;

b. fluxing the molten metal by flowing a gas selected from the group consisting of chlorine, nitrogen, argon or other inert gas and mixtures thereof, through the molten metal, c. adsorbing selected impurities by passing the molten metal over an adsorptive refractory material selected from the group consisting of aluminum oxide, calcium oxide, mullite, and silicon carbide, said selected material having an affinity for said selected impurities in the molten metal; and d. filtering the molten metal through a rigid porous refractory filter medium to remove impurities not removed in said deslagging and adsorbing steps.

* * * * *